US006073768A

United States Patent [19]

McCord et al.

[11] Patent Number: 6,073,768

[45] Date of Patent: Jun. 13, 2000

[54] PACKAGING SYSTEM

[75] Inventors: Thad Syfan McCord, Greer; Russell Butler, Greenville; Randy Johnson, Greer, all of S.C.; Jim Wright, Greensboro, N.C.

[73] Assignee: Mitsubishi Polyester Film, LLC, Greer, S.C.

[21] Appl. No.: 09/080,760

[22] Filed: May 18, 1998

Related U.S. Application Data

[60] Provisional application No. 60/047,958, May 29, 1997.

[51] Int. Cl.[7] ..... B65D 85/66

[52] U.S. Cl. ..... 206/408; 206/413; 206/600; 220/115

[58] Field of Search ..... 206/389, 408, 206/410, 413, 386, 596–598, 600, 1.5, 557–564; 220/1.5, 4.01, 4.28, 4.33, 4.34; 217/43 A, 45; 53/409, 393

[56] References Cited

U.S. PATENT DOCUMENTS

| | | | |
|---|---|---|---|
| 1,885,483 | 11/1932 | Samuelson | 206/564 |
| 2,471,693 | 5/1949 | Lilienfeld . | |
| 3,369,659 | 2/1968 | Ettlinger, Jr. | 206/564 |
| 4,320,838 | 3/1982 | Braver | 206/564 |
| 4,779,751 | 10/1988 | Munroe | 220/1.5 |
| 4,872,723 | 10/1989 | Kopf | 206/564 |
| 5,251,771 | 10/1993 | Hotsumi et al. | 220/4.01 |
| 5,269,455 | 12/1993 | Grigsby et al. | 206/386 |
| 5,323,910 | 6/1994 | Van De Graaf, Jr. | 206/564 |
| 5,579,918 | 12/1996 | McCurry | 206/600 |
| 5,597,084 | 1/1997 | Parasin | 206/600 |
| 5,678,694 | 10/1997 | Tanaka et al. | 206/564 |

*Primary Examiner*—Paul T. Sewell
*Assistant Examiner*—Luan K. Bui

[57] ABSTRACT

A packaging system for transporting an article includes: a base; a pair of opposing side walls resting on the base; a cross member extending between the side walls; and a block removably attached to said base. The removable block has a first portion with an upper surface; a lower surface; a first side surface extending between the upper and lower surfaces; and an aperture extending through the block to accommodate a fastener therein for securing the block to the shipping container. The block optionally include a toe portion extending from the first side surface of the first portion. The toe portion is receivable within a portion of the shipping container. Alternatively, the packaging system could include: a base; a pair of side walls resting on the base; a cross member extending between the side walls; and a bracket removably attached to a notch in a distal end of one of the side walls to receive the cross member therein. The bracket includes a base; and a pair of arms extending from the base. An opening is formed between the base and the arms to receive a component of the shipping container therein.

24 Claims, 6 Drawing Sheets

PACKAGING SYSTEM

CROSS-REFERENCE TO RELATED APPLICATIONS

This application is related to U.S. provisional patent application Ser. No. 60/047,958, filed on May 29, 1997, herein incorporated by reference.

BACKGROUND OF THE INVENTION

The present invention relates generally to a packaging system which provides improved stability and packing capabilities for wide-web roll products. More specifically, the present invention relates to the use of a stabilizer in the form of a T-shaped or L-shaped block, and a U-shaped bracket. The T-shaped block has a portion which is inserted into pre-notched flanges for receiving the stabilizer. The stabilizer is subsequently attached to the packaging base such as a wooden pallet. The L-shaped block secures corners of the shipping container. The U-shaped bracket is inserted with notches in the stabilizer. The U-shaped bracket subsequently accommodates horizontal supports therein to secure the various components of the packaging system together.

It is known within the art of packaging to use wooden pallets or a slotted wood package in which a wooden base is used to secure a bulky, heavy or cumbersome article.

Prior art slotted wooden packaging often used aluminum channels as securing members. The article and/or its support rests upon the channel which in turn is supported by the wooden base. Other packaging methods include the use of permanent or difficult to remove securing devices which attach the article to the package base. Furthermore, other packaging methods involve the modification of the support pieces, for example notching the horizontal support members.

The prior art attachment methods are time consuming to install and to remove. With a greater emphasis on recycling package components, particularly expensive wooden components, there is a need in the woods package industry to provide a package having an improved and reusable particle attachment and securement apparatus.

Clearly, there is room for improvement in the art.

SUMMARY OF THE INVENTION

Therefore, it is an object of the present invention to provide an improved packaging system.

It is a further object of the present invention to provide an improved packaging system using a block to stabilize portions of a shipping container.

It is a further object of the present invention to provide an improved packaging system that uses a reusable molded plastic stabilizer where a portion of the stabilizer is inserted into a notched flange supporting a carried article in order to provide greater planar stability for wide web roll goods during shipment.

It is a further object of the present invention to provide an improved packaging system that uses a reusable molded plastic bracket insertable within a notch in the stabilizer and capable of accommodating a horizontal support therein.

It is a further object of this invention to provide packaging which provides a greater level of support for articles carried on a pallet or wood base support.

It is a further object of the present invention to provide a packaging system that does not require alterations to the horizontal supports.

These and other object are achieved in a first aspect of the present invention by a packaging system for transporting an article. The packaging system includes a base; a pair of opposing side walls resting on the base; a cross member extending between the side walls; and a block removably attached to said base.

These and other objects are achieved in a second aspect of the present invention by a block removably attached to a shipping container. The block has a first portion with an upper surface; a lower surface; a first side surface extending between the upper and lower surfaces; and an aperture extending through the block to accommodate a fastener therein for securing the block to the shipping container. The block optionally include a toe portion extending from the first side surface of the first portion. The toe portion is receivable within a portion of the shipping container.

These and other aspects are achieved in a third aspect of the present invention by a packaging system for transporting an article. The packaging system includes a base; a pair of side walls resting on the base; a cross member extending between the side walls; and a bracket removably attached to a notch in a distal end of one of the side walls to receive the cross member therein.

These and other objects are achieved in a fourth aspect of the present invention by a bracket for securing components of a shipping container together. The bracket includes a base; and a pair of arms extending from the base. An opening is formed between the base and the arms to receive a component of the shipping container therein.

BRIEF DESCRIPTION OF THE DRAWINGS

The features of the present invention will become apparent to those skilled in the art to which the present invention relates from reading the following specification with reference to the accompanying drawings in which.

DETAILED DESCRIPTION OF THE PREFERRED EMBODIMENTS

First, one alternative embodiment of the present invention will be described with reference to FIGS. 1–7. Then, another alternative embodiment of the present invention will be described with reference to FIGS. 8–11.

As seen in the figures, a packaging system 1 is provided which can be used for the transportation of an article therein. As will be described below, packaging system can be assembled and broken down quickly. Clearly, packaging system 1 is capable of repeated use.

Figure 1:
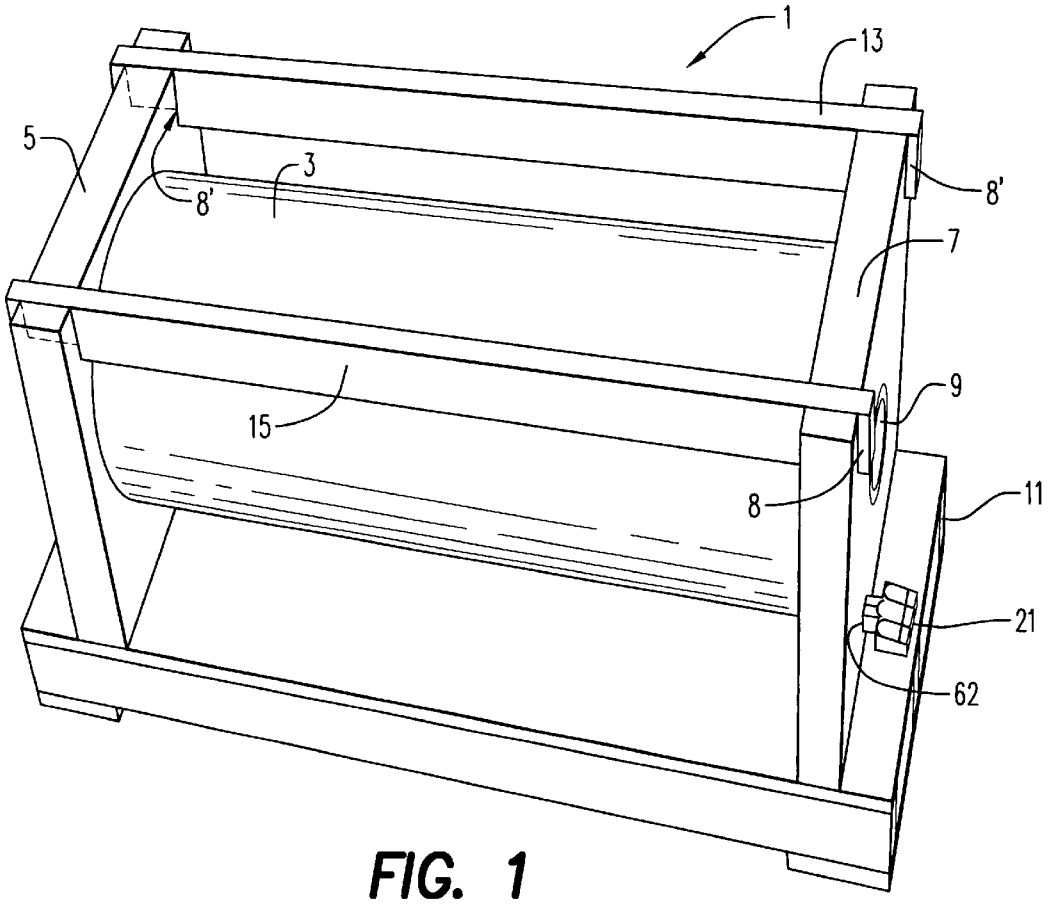
FIG. 1 is a perspective view of a wide web roll object which is packaged in accordance with a first alternative embodiment of the present invention.

As particularly shown in FIG. 1, packaging system 1 can be used to transport a wide web roll 3. Web roll 3 is supported on either roll end by respective terminal flanges 5 and 7.

Both flanges 5 and 7 define a respective receiving aperture which engages a hollow core 9 upon which the web material comprising roll 3 is wound. A base or pallet 11 is provided which has a well known configuration to facilitate movement of the package by a forklift or similar device. Pallet 11 can be made, for example, out of wood. A series of horizontal supports 13, 15 secure and retain each flange 5, 7 about roll 3. Supports 13, 15 are notched at each end. Notches 12 receive an upper edge of the respective flanges 5 and 7. As seen in FIG. 1, flanges 5 and 7 each define a pair of slits 8 and 8' which engages the respective support notches 12 in horizontal supports 13, 15.

Figure 3:
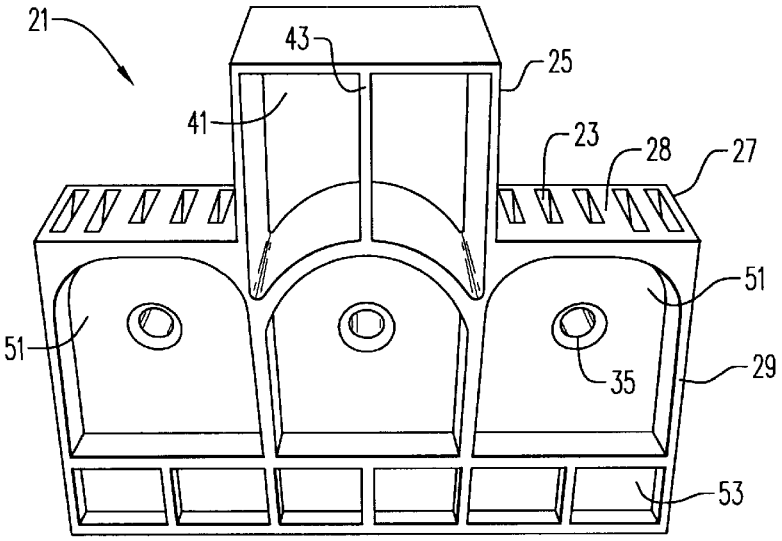
FIG. 3 is a plan top view of details of a stabilizer used in accordance with the present invention.
Figure 2:
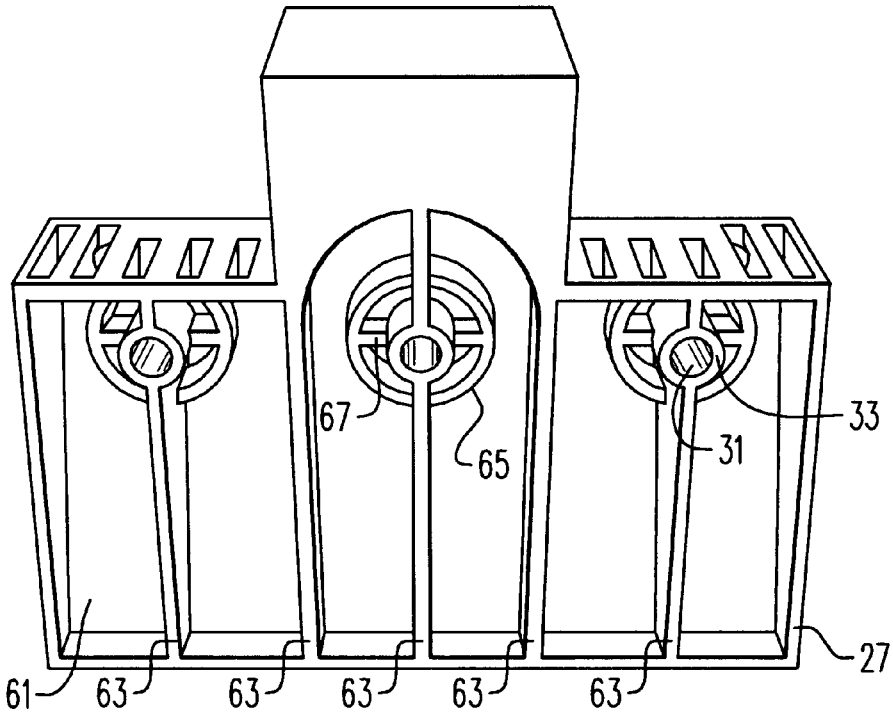
FIG. 2 is a plan bottom view of a stabilizer used in accordance with the present invention.
Figure 4:
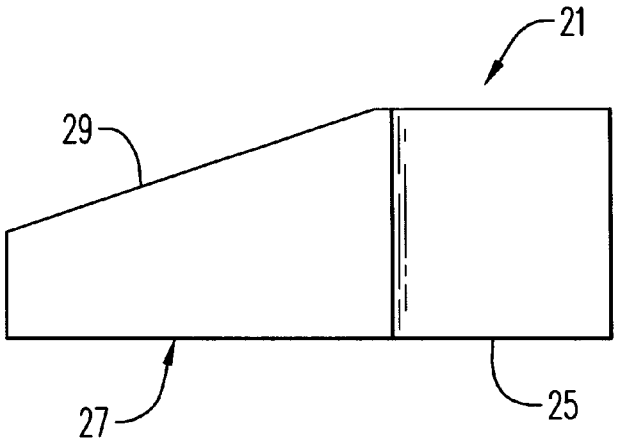
FIG. 4 is a side view of the stabilizer seen in FIG. 3.

As seen in greater detail in FIGS. 2 and 3, a stabilizing block 21 is seen having an inverted T-shape with a substantially wedge-shaped support 23, one edge of which further defines a smaller rectangular toe portion 25. As viewed from a side as seen in FIG. 4, a lower surface 27 of block 21 provides a substantially level surface for engaging a similar level surface of wooden base 11. The upper surface 29 of the wedge-shaped support 23 tapers upwardly to an edge wall 28. Toe portion 25 is integral with edge wall 28 and projects outwardly and from the edge of the wedge-shaped support 23. Toe portion 25 has a substantially level upper and lower surfaces.

As seen in FIGS. 2 and 3, a plurality of apertures 31 are defined within the wedge-shaped support 23. Apertures 31 are surrounded by a sleeve or cylinder 33 of block material. Each aperture 31 provides communication between the upper sloped surface 29 and the lower surface 27. Each aperture 31 is substantially linear and extends parallel relative to the other apertures 31. Apertures 31 are perpendicular relative to tapered surface 29 and are angled relative to lower surface 27. Circular recesses or grooves 35 are defined on upper surface 29 surrounding each aperture 31. The grooves permit fasteners, for example wood screws (not pictured), to be countersunk relative to the adjacent block surface.

As seen in FIG. 3, the toe portion 25 comprises an open box. Toe portion 25 has a bottom surface and side walls forming a hollow cavity 41. A septum 43 extends through hollow cavity 41 from one side wall to support 23. All of the notches, webs and ribs provide rigidity to block 21, while reducing the amount of material required to form block 21. Upper support surface 29 also defines a series of shallow recessed regions 51 surrounding apertures 33, and a series of shallow notches 53 along the lower edge of surface 29.

Lower surface 27 defines a plurality of cavities 61 and a plurality of supporting ribs or webs 63. Ribs 63, along with the walls along the outer perimeter of the lower surface of block 21 define the engaging portions of lower surface 27. Some of the ribs are co-extensive with cylinders 33 which surround apertures 31. Each cylinder 33 is further supported by arcuate segments 65. A linear tab 67 extends between cylinder 33 and arcuate segments 65. Tabs 67 are integral with cylinder 33 and arcuate segment 65, providing additional strength and rigidity to cylinder 33.

The stabilizing blocks provide a method to improve the horizontal stability to wide web roll goods during shipment. The support flanges 5 and 7 each define an aperture or notch 62 adjacent a lower edge of each flange 5, 7 that rest upon wooden base I1. Preferably, aperture 62 is a notch that extends inwardly from the lower edge of flanges 5, 7. However, Applicant also recognizes that aperture 62 could merely be positioned adjacent the lower edge of flange 5, 7. The stabilizing block 21 is inserted so that the toe piece 25 engages the notch while block wall 28 further engages the exterior flange wall. Once positioned, a securing device such as screws are inserted into each aperture and used to secure the stabilizing block to the wooden base 11.

Figure 7:
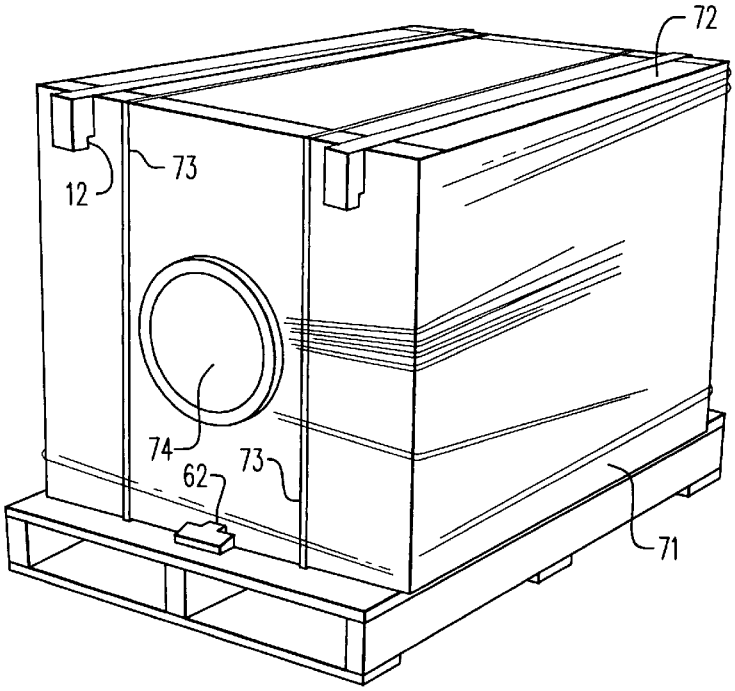
FIG. 7 is a perspective view of a wide web roll object seen in FIG. 1 with the addition of stabilizing straps, core extensions, protective stretch wrap and dust cover.
Figure 9:
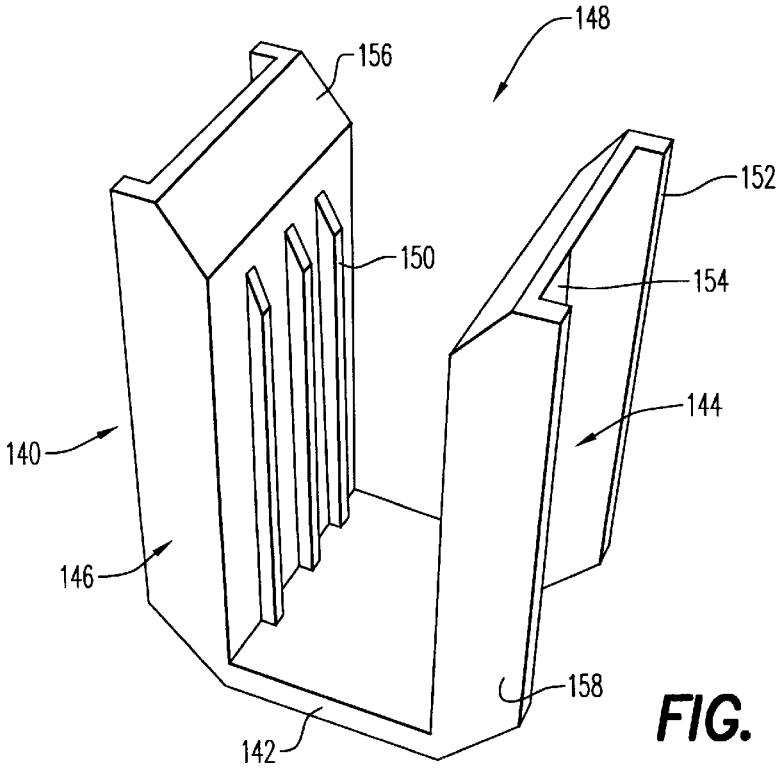
FIG. 9 is a perspective view of the U-shaped bracket in the alternative embodiment of the present invention shown in FIG. 8.

If desired, as seen in FIG. 7, the package can be further enclosed with a stretch-wrap material 71 and a dust cover 72 to keep dust and contaminants from soiling the roll during shipment. Stabilizing straps, 73, may be employed during the packaging process in order to impart further stability to the terminal flanges, 5 and 7, subsequent to their engagement with the hollow core 9, but prior to their placement upon a wooden base or pallet 11. Each stabilizing strap is looped around the outside faces of both terminal flanges, encircling the entire wide web package and running parallel to the hollow core 9. A stabilizing strap is placed on each side of the hollow core 9. In addition, a core insert 74 may be employed if an insufficient amount of the hollow core 9 extends beyond the web material to provide a suitable surface for engagement of the terminal end flange apertures. These core inserts are hollow cylindrical objects whose outer diameter at one terminus end is larger than the hollow core 9 inner diameter. The diameter of the opposite terminus end of the core insert is of slightly smaller diameter than the hollow core 9, and it is this end which is placed into the apertures of the terminal end flange and hollow core, after the terminal end flange has been positioned so that its aperture aligns with that of the hollow core. The use of core extensions in wide web roll packaging is known in the art.

The stabilizing block is preferably injection molded from a plastic material such as polyethylene which allows for uniform size and consistency. However, a wide variety of other plastics could be used. Furthermore, fiberglass, nylon, rubber, wood, metal or other suitable materials could also be used. The uniform size and specific locations for fasteners allows automation of the fastening of the T-block to the wooden base. The stabilizing blocks are easily removed and the smooth surface is safely handled and easily cleaned.

As seen in FIGS. 1–4 and 7, the stabilizing block 21 provides a plurality of ribs on both upper and lower surfaces in association with a wide number and variety of cavities and notches. As discussed above, the cavities, notches, webs and ribs reduce the material cost and weight of the stabilizing block, and provide increased strength to the overall design of packaging system 1.

Packaging system 1 can be assembled as follows. Base 11 and one flange 5 are secured together prior acing web roll in packaging system 1. Base 11 and flange 5 can be secured together using known techniques, or using stabilizing block 21. The product is then placed on base 11. If the product is web roll 3, one end of hollow core 9 supporting web roll 3 inserts into a corresponding aperture in flange 5. Second flange 5 is then placed on base 11. Again, if the product is web roll 3, the opposite end of hollow core 9 is placed within the corresponding aperture in second flange 5. Toe portion 25 of stabilizing block 21 inserts within notch 62 at the bottom portion of second flange 5. Stabilizing block 21 is then secured to base 1, using fasteners, such as wood screws. Horizontal supports 13, 15 are then provided to extend between flanges 5 to provide lateral support. Notches in the upper surfaces of flanges 5 receive horizontal supports 13, 15. Horizontal supports 13, 15 have corresponding notches on a lower edge. The corresponding notches secure horizontal supports 13, 15 to flanges 5. If desired, any combination of stretch wrap 71, dust cover 72, securing straps 73 can be used for additional stability of the shipping container and protection of the product.

The injection molded stabilizing blocks are easy to reuse and/or recycle. Fasteners, such as wood screws, do not damage the stabilizing blocks. Preferably, no threads are provided within the apertures to further encourage reuse. Rather, the apertures 31 merely guides fastener such as a self-drilling screw to the adjacent wooden base. As the fastener engages the wood, the stabilizing block is held in proper position. As discussed above, apertures 31 are angled relative to lower surface 27. This propels block 21 towards flanges 5, 7 while the fasteners are inserted and secured to base 11, thereby additionally securing packaging system 1 together.

The plastic molded stabilizing block is easily cleaned and is ideally suited for applications where contamination control is required.

Figure 5:
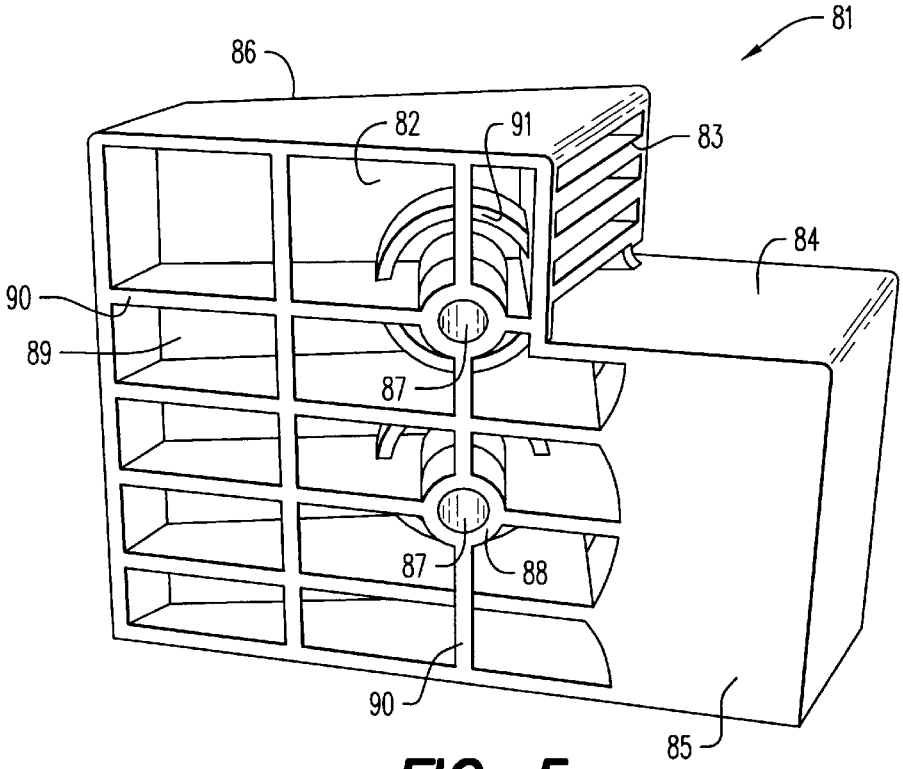
FIG. 5 is an alternative embodiment of an L-shaped stabilizer in accordance with one aspect of the present invention.
Figure 6:
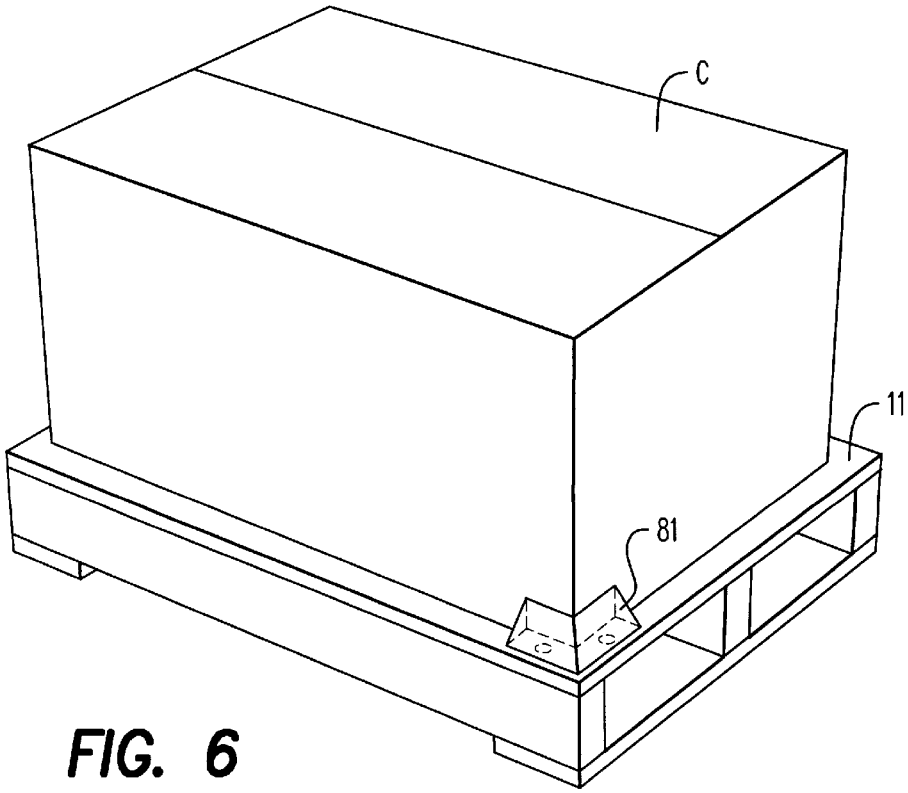
FIG. 6 is a perspective view of a package as secured with the stabilizer seen in FIG. 5.

An alternative embodiment of stabilizing block 21 can be seen in FIGS. 5 and 6. Rather than T-shaped block 21, FIG. 5 displays an L-shaped stabilizing block 81 which is useful for securing corners of a shipping box or carton C. In essence, stabilizing block 81 combines two wedge portions of stabilizing block 21, disposed substantially perpendicular to each other. The L-shaped stabilizing block 81 is comprised of two substantially wedge-shaped supports 82 joined at a right angle, which employs two front faces 83 and 84 to engage the corner of a box or carton. The two front faces 83, 84 are positioned so as to form a right angle. A lower surface 85 of block 81 provides a substantially level surface for engaging a similar level surface of wooden base 11. The upper surface 86 of the wedge-shaped support 82 tapers upwardly to the front faces 83, 84.

As seen in FIG. 5, a pair of apertures 87 are defined within the wedge-shaped support 82. Each aperture 87 is surrounded by a sleeve or cylinder 88 of block material, and provides communication between the upper sloped surface 86 and the lower surface 85. Each aperture 87 is substantially linear and extends parallel to the other apertures 87. Apertures 87 are perpendicularly arranged relative to the tapered surface 86 and are angled relative to lower surface 85. Lower surface 85 defines a plurality of cavities 89 and a plurality of supporting webs or ribs 90. Ribs 90 along with the walls along the outer perimeter of the lower portion of block 81 define the engaging portions of lower surface 85. As seen in FIG. 6, the L-shaped stabilizing block seen in FIG. 5 provides stability to boxes or cartons when employed at diagonal corners.

The other alternative embodiment of the present invention will now be described with reference to FIGS. 8–11. This alternative embodiment uses most of the features described in the previously described first alternative embodiments of the present invention. Features described in this alternative embodiment that are common to the first alternative embodiments use the same reference character, except for a change in the hundred digit. The only difference between the first and second alternative embodiment resides in the manner of connecting the horizontal supports to the flanges. Thus, to avoid undue repetition with what was described above with reference to the first alternative embodiments, only the manner of connecting the horizontal supports to the flanges will be discussed.

Instead of notching horizontal support 113 (as was done with horizontal support 13 of the first alternative embodiment), the second alternative embodiment uses a bracket 140 to secure horizontal support 113 to flange 105. By using bracket 140, horizontal support 113 does not require notches.

Bracket 140 is U-shaped. Bracket 140 has a base 142 with arms 144, 146 extending from opposite ends thereof. A transverse opening 148 extends between arms 144, 146. Transverse opening 148 accommodates horizontal support 113 therein.

Arms 144, 146 are U-shaped, having a base portion 154 and flanges 152 extending from opposite ends of base portion 154. Flanges 152 extend from base portion 152 in a direction away from transverse opening 148. The distal ends of base portion 154 include an angled portion 156. Angled portion 156 tapers away from transverse opening 148. The proximal ends of flanges 152 include a tapered portion 158. Tapered portion 158 tapers towards transverse opening 148. Each arm 144, 146 can have a plurality of spines 150 extending into transverse opening 148 from base portion 154. Spines 150 provide additional rigidity to bracket 140. Spines 150 are also connected to base 142.

Flanges 152 of arms 144, 146 are positioned a sufficient distance apart in order to accommodate flange 105 therebetween. Likewise, base 142 has a width slightly larger than the thickness of flange 105.

Figure 8:
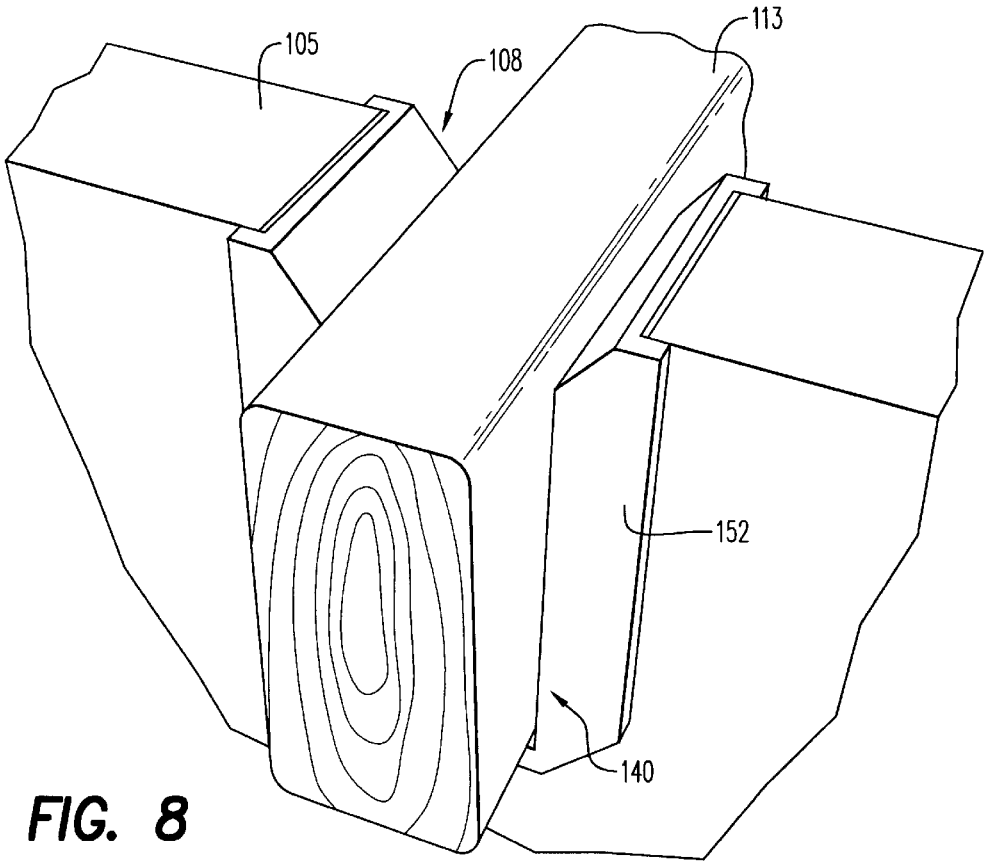
FIG. 8 is a partial perspective view of another alternative embodiment of the present invention utilizing a U-shaped bracket.
Figure 10:
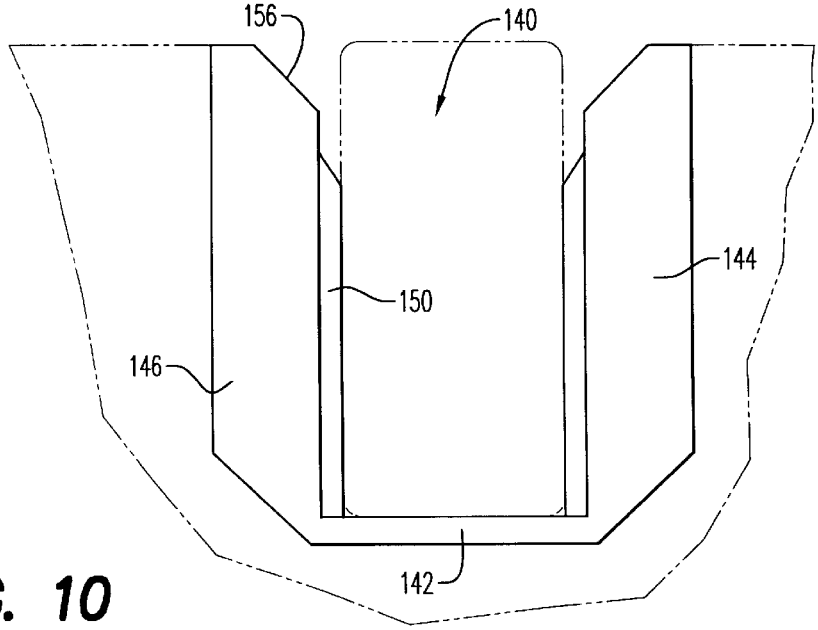
FIG. 10 is a side, elevational view of the U-shaped bracket in the alternative embodiment of the present invention shown in FIG. 8.
Figure 11:
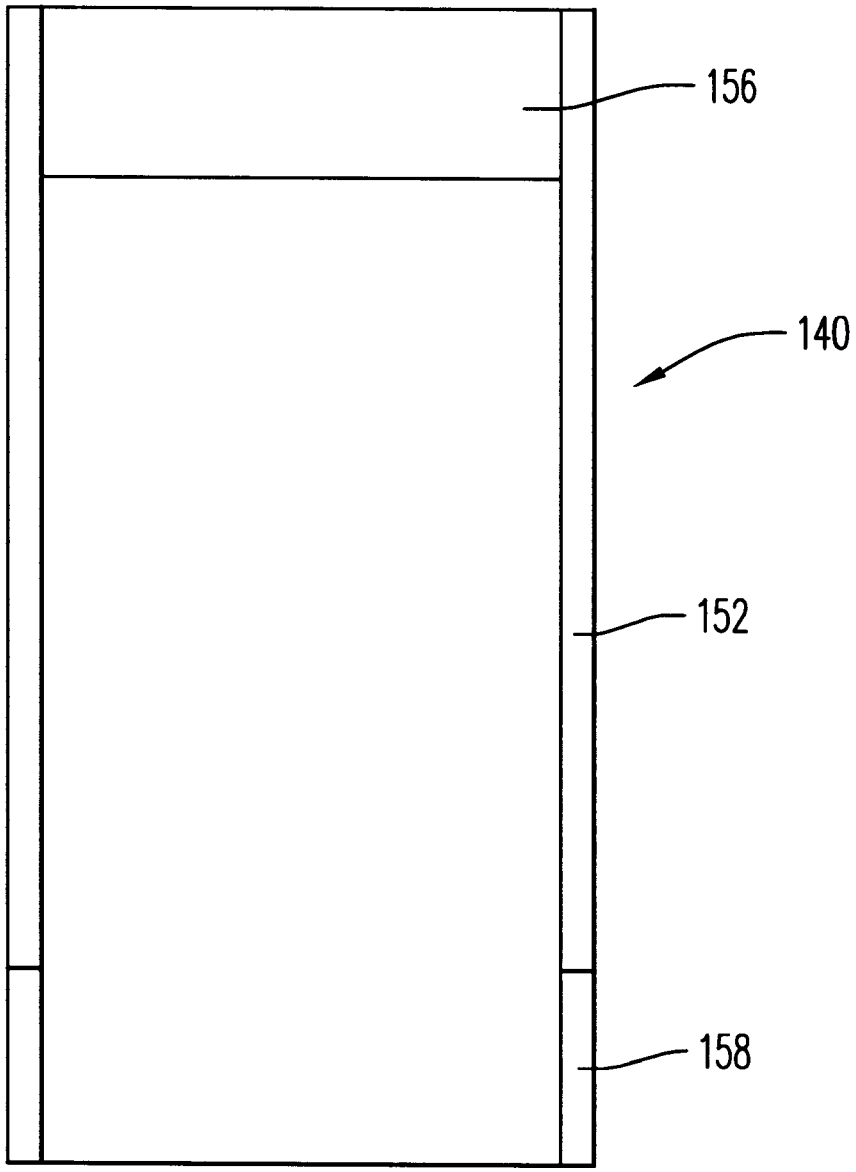
FIG. 11 is a front, elevational view of the U-shaped bracket in the alternative embodiment of the present invention shown in FIG. 8.

During use as shown in FIG. 8, bracket 140 sits within slit 108 in flange 105. Substantially planar base 142 rests on a bottom (horizontal) edge of slit 108. The substantially planar exterior surfaces of base portion 154 of arms 144, 146 rest against the (vertical) edges of slit 108. Flanges 152 engage opposite side surfaces of flange 105. As a result, bracket 140 cannot readily exit slit 108 in flange 105. In other words, the person assembling or disassembling the packaging system must remove bracket 140 from slit 108 in flange 105. Also seen in FIG. 8, distal ends of arms 144, 146 extend a distance from base 142 so as to be substantially flush with the edge of flange 105.

Horizontal support 113 sits within transverse opening 148. In order to accommodate horizontal support 113, the distance between arms 144, 146 must be greater than the width of horizontal support 113. Preferably, horizontal support 113 rests on base 142 and is positioned between spines 150 on opposite arms 144, 146. Angled portions 156 allow easy insertion of horizontal support 113 within transverse opening 148. Even if horizontal support 113 is skewed, horizontal support 113 will slide down angled portion 156 and into transverse opening 148.

As with T-block support 21 and L-block support 81, bracket 140 is preferably injection molded from a plastic material such as polyethylene. Injection molding provides more uniform size and consistency between different brackets. Other types of plastic could be used. Furthermore, fiberglass, nylon, rubber, wood, metal or other suitable material could also be used.

Applicants understand that many other variations are apparent to one of ordinary skill in the art from a reading of the above specification. Such variations are within the spirit and scope of the instant invention as defined by the following appended claims.

I claim:

1. A packaging system for transporting an article, comprising:

a base having an upper surface;

a pair of opposing side walls, each of said pair of side walls comprises:

a proximal end resting on said upper surface of said base; and a distal end;

at least one cross member extending between said pair of side walls; and at least one block removably attached to said base, said at least one block comprising:

a first portion, comprising:

an upper surface;

a lower surface positioned adjacent said upper surface of said base;

a first side surface extending between said upper and lower surfaces of said block; and at least one aperture extending through said block to removably accommodate a fastener therein to secure said block to said base.

2. The packaging system for transporting an article as recited in claim 1, wherein said proximal end of one of said pair of side walls includes an aperture; and wherein said block further comprises:

a toe portion extending from said first side surface of said first portion, said toe portion receivable within said aperture in one of said pair of side walls.

3. The packaging system for transporting an article as recited in claim 2, wherein said proximal end of each of said side walls has a proximal edge; and wherein said aperture in said side wall extends from said proximal edge.

4. The packaging system for transporting an article as recited in claim 1, wherein each of said pair of side walls further comprises:

an article supporting aperture positioned between said proximal and distal ends for supporting a portion of the article therein.

5. The packaging system for transporting an article as recited in claim 1, wherein said first portion is a wedge portion; and wherein said upper surface of said wedge portion is angled relative to said lower surface.

6. The packaging system for transporting an article as recited in claim 5, wherein said at least one aperture extends from said upper surface to said lower surface of said wedge portion; and said at least one aperture extends perpendicularly to said upper surface of said wedge portion.

7. The packaging system for transporting an article as recited in claim 2, wherein said toe portion is centrally positioned along said first side surface of said first portion.

8. The packaging system for transporting an article as recited in claim 2, wherein said toe portion comprises:

a lower surface coplanar with said lower surface of said first portion;

a pair of side walls extending from said first side surface of said first portion;

an end wall extending between said pair of side walls; and a hollow interior formed between said lower surface, said pair of side walls and said end wall.

9. The packaging system for transporting an article as recited in claim 8, wherein said toe portion further comprises:

a web extending within said hollow interior and between said first side surface of said first portion and said end wall.

10. The packaging system for transporting an article as recited in claim 1, wherein each of said at least one aperture in said first portion is formed by a first cylinder extending between said upper and lower surfaces of said first portion; and wherein said lower surface of said first portion further comprises:

a recess surrounding said at least one first cylinder.

11. The packaging system for transporting an article as recited in claim 10, wherein said first portion further comprises:

at least one second cylinder within said recess, said at least one second cylinder extending from said upper surface of said first portion, and said second cylinder being substantially coaxial with said at least one first cylinder.

12. The packaging system for transporting an article as recited in claim 11, wherein said first portion further comprises:

at least one tab extending between said at least one first cylinder to said at least one second cylinder.

13. The packaging system for transporting an article as recited in claim 10, wherein said first portion further comprises:

a second side surface opposite said first side surface;

a web extending between said first side surface and said at least one first cylinder; and a web extending between said second side surface and said at least one first cylinder.

14. The packaging system for transporting an article as recited in claim 1, wherein said first side surface of said first portion includes:

a plurality of ribs.

15. The packaging system for transporting an article as recited in claim 1, wherein said block is made of plastic.

16. The packaging system for transporting an article as recited in claim 1, wherein at least one of said opposing side walls has a notch therein adapted to accept a portion of said block.

17. The packaging system for transporting an article as recited in claim 1, wherein said block is removable without releasing any significant weight of said side wall.

18. The packaging system for transporting an article as recited in claim 1, wherein said block is in contact with but is not affixed to said side wall.

19. The packaging system for transporting an article as recited in claim 1, wherein said block is affixed to said base and not to said side wall.

20. An apparatus for securing parts of a shipping container together, comprising: a first portion, comprising:

an upper surface;

a lower surface;

a first side surface extending between said upper and lower surfaces; and at least one aperture extending through said first portion, wherein said at least one aperture in said first portion is formed by a first cylinder extending between said upper and lower surfaces of said first portion;

wherein said lower surface of said first portion fiber includes:

a recess surrounding said first cylinder; and wherein said first portion further comprises:

at least one second cylinder within said recess, said at least one second cylinder extending from said upper surface of said first portion, and said second cylinder being substantially coaxial with said at least one first cylinder.

21. The apparatus for securing parts of a shipping container together as recited in claim 20, wherein said first portion further comprises:

at least one tab extending between said first cylinder to said at least one second cylinder.

22. A package for a wide web roll comprising:

a cylindrical core having a first end, a second end, and a width;

an endless web of material wound about said core, said web having a width less than the width of said core;

a first flange defining an opening for receiving a first end of said core;

a second flange defining an opening for receiving a second end of said core;

a base supporting a respective lower edge of both said first and said second flange;

a first horizontal support defining a first notch and a second notch, each said notch engaging a respective slit defined by an upper end of said first and said second flange;

a second horizontal support defining a first notch and a second notch, each said notch engaging a respective slit defined by an upper edge of said first and said second flange;

a first stabilizing block having a toe portion engaging a notch defined by a lower side edge of said first flange, said block reversibly secured by a fastener to said base;

a second stabilizing block having a toe portion engaging a notch defined by a lower side of said second flange, said block reversibly secured by a fastener to said base.

23. A method of securing a wide web roll to a packaging base comprising:

providing a web of material carried upon a central roll, said roll having a length greater than the width of said web;

inserting a first free end of said web roll into an opening defined by a first upright, said first upright carried by a base;

inserting a second free end of said web roll into an opening defined by a second upright, said second upright carried by said base;

providing a notch along a lower side of at least one of said first upright and said second upright;

positioning a block having a toe portion adjacent said notch, said toe portion of said block engaging said notch, said block further engaging an exterior portion of said upright in proximity to said notch;

securing said block to said base.

24. A method of securing a product to a packaging base comprising:

providing a product having a central post, affixing a first free end of said post to a first upright, said first upright carried by a base;

affixing a second free end of said post to a second upright, said second upright carried by said base, wherein at least one of said first upright and said second upright has a notch at a lower part thereof, positioning a block having a toe portion adjacent said notch, said toe portion of said block engaging said notch, said block further contacting an exterior portion of said upright in proximity to said notch;

securing said block to said base.

* * * * *